US006354026B1

(12) United States Patent
Trevisani

(10) Patent No.: US 6,354,026 B1
(45) Date of Patent: Mar. 12, 2002

(54) TRENCH RIG

(75) Inventor: Davide Trevisani, Cesena (IT)

(73) Assignee: Trevi-S.p.A., Cesena (IT)

( * ) Notice: Subject to any disclaimer, the term of this patent is extended or adjusted under 35 U.S.C. 154(b) by 0 days.

(21) Appl. No.: 09/342,620

(22) Filed: Jun. 29, 1999

(30) Foreign Application Priority Data

Jul. 3, 1998 (IT) ..... TO98A0582

(51) Int. Cl.[7] ..... E02F 3/08
(52) U.S. Cl. ..... 37/355; 37/352; 37/462
(58) Field of Search ..... 37/352, 353, 355, 37/359, 362, 462, 463

(56) References Cited

U.S. PATENT DOCUMENTS 1,769,074 A * 7/1930 Ruatti
3,388,487 A * 6/1968 Peck
3,659,364 A * 5/1972 Wilson
4,164,082 A * 8/1979 Watson

FOREIGN PATENT DOCUMENTS

EP 0 633 361 B1 11/1997

* cited by examiner

*Primary Examiner*—H. Shackelford
(74) *Attorney, Agent, or Firm*—Merchant & Gould P.C.

(57) ABSTRACT

A trench rig (1) for excavating continuous monolithic brattices or bases, presenting a self-propelled crawler truck (2), a chain-driven excavating tool (6) provided with a central column (9) which extends along a working axis (A), and a control unit (8) for the column (9) presenting a fixed gripper (15) in relation to the truck (2) and a mobile gripper (16) in relation to the fixed gripper (15) itself; the two grippers (15, 16) are slidingly coupled to the column (9), and can be selectively engaged to the column (9) itself in order to move the tool (6) along the working axis (A), and are connected to each other by a linear step actuator (17).

11 Claims, 5 Drawing Sheets

TRENCH RIG

The present invention relates to a trench rig.

In particular, the present invention relates to a trench rig for excavating monolithic brattices, bases or monolithic areas, to which the description which follows will make specific reference without losing its generality in any way.

Generally, well-known trench rigs of the type described above include a chain-driven excavating tool; a means for transporting the excavating tool itself; and an orientation device, which is suitable for varying the depth at which the tool excavates. These well-known types of trench rigs are generally defined by a hinge with a horizontal axis which is interposed between the tool and the means of transport to rotate, when in use, the tool itself, thus varying the tool's driving angle, or the excavation depth itself.

In some types of well-known trench rigs, for example the kind described in European Patent No. 0 633 361, the orientation device is replaced by a guide antenna, which is revolvingly mounted on the means of transport, and which supports the already cited excavating tool by means of a sliding slide along the guide antenna itself. In the types of trench rigs which have just been described, the excavating tool usually works in a given operating position, in which the tool itself is driven vertically into the ground, and in which the depth of excavation is varied by sliding the slide along the guide or rather by sliding the tool in relation to the guide antenna.

The trench rig described in the above-mentioned European Patent, while permitting decidedly greater depths of excavation than those reached using trench rigs provided with a hinge, nevertheless presents a number of drawbacks which considerably limit the use of this kind of trench rig. In fact, once the excavation tool is vertically positioned in its operating position, the dimensions of the guide antenna define a considerable bulk in the area above the tool itself, thus limiting the use of the rig in working areas which contain overhead obstacles, such as electrical cables or tunnel vaults.

The aim of the present invention is to realise a trench rig which will resolve the drawbacks described above in a simple and cost-effective manner.

According to the present invention a trench rig comprises an excavating tool presenting a working axis, and means of transport associated with the excavating tool for transporting the excavating tool itself in a given direction; the rig comprising control means which are interposed between the excavating tool and the means of transport for controlling the excavating tool itself around an axis which is transversely orientated to the said working axis and along the working axis itself; the control means comprising clamping means which are selectively engageable directly onto said excavating tool in order to move the excavating tool itself along the working axis.

The invention will now be described with reference to the attached drawings, which illustrate a non-limiting example embodiment of the invention, in which.

Figure 1:
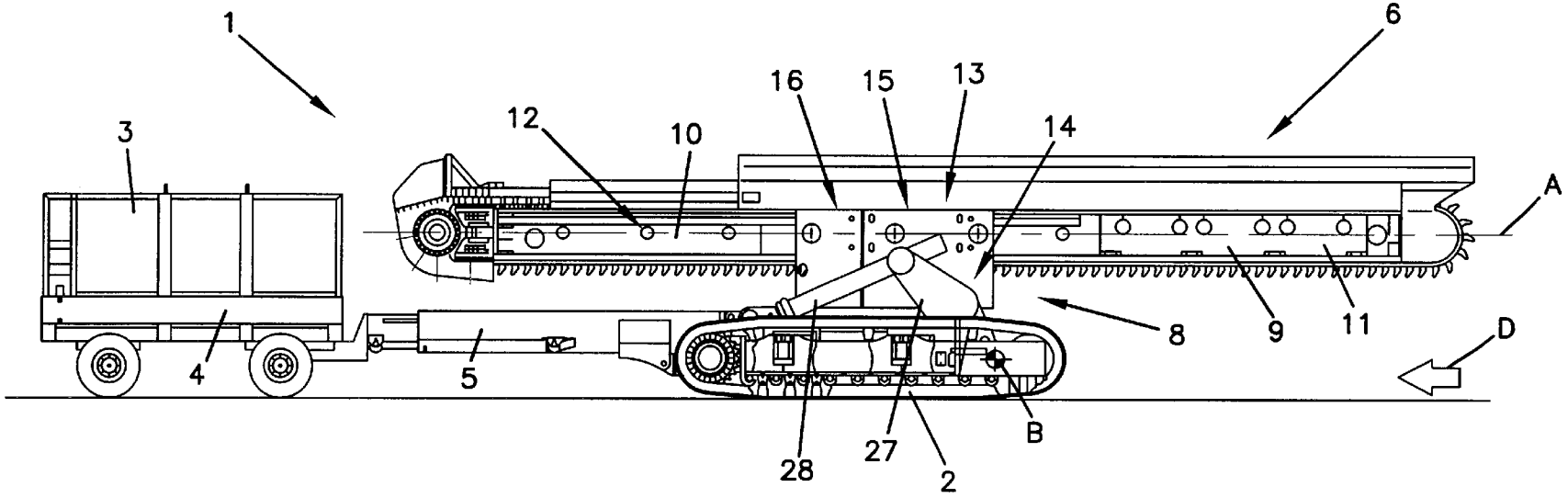
FIGS. 1 and 2 show a lateral elevation view of a first preferred embodiment of a trench rig according to the present invention in two different respective operating positions.
Figure 2:
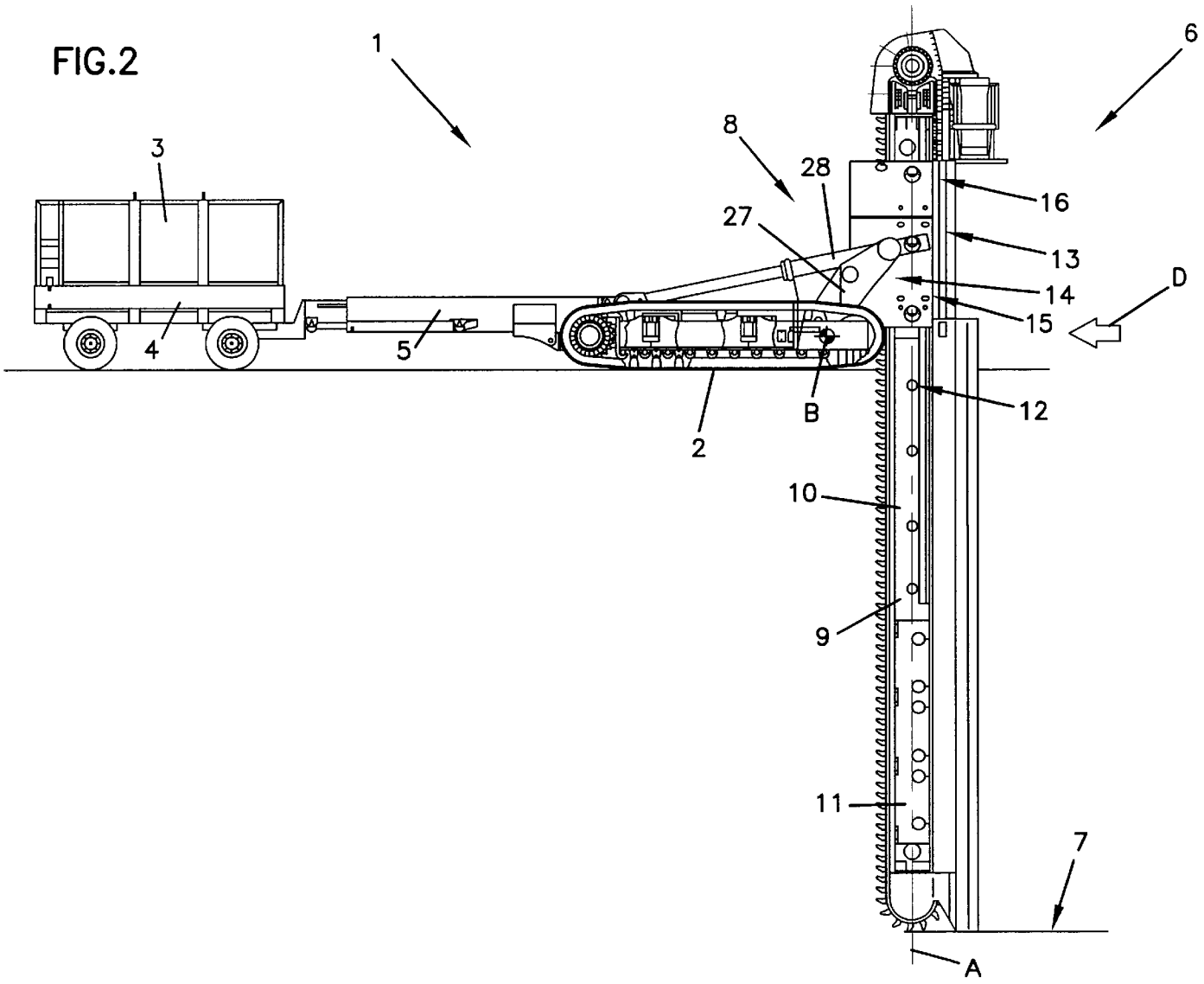

With reference to FIGS. 1 and 2, the number 1 indicates, in its entirety, a trench rig for the excavation of continuous monolithic brattices or bases.

The rig 1 comprises a self-propelled crawler truck 2, which moves in a given direction D, a power unit 3 mounted on a trolley 4, a rigid connecting drawbar 5 between the truck 2 and the unit 3 and a chain-driven excavating tool 6, which presents a main working axis A, and is suitable for realizing an excavation or trench 7. The rig 1 further comprises a control group 8 for the tool 6 interposed between the truck 2 and the tool 6 itself for rotating the tool 6 itself around a B axis which is transversely and horizontally orientated in relation to the A axis and the direction D in such a way as to vary the driving angle of the tool 6 into the ground, and for guiding the tool 6 itself parallel to the A axis in such a way as to vary the depth of the trench 7.

The tool 6 is defined by a frontal milling module cutting miller or "vertical trencher", which, when advanced in the direction D of the truck 2, is suitable for excavating the trench 7 in the direction D itself. The tool 6 comprises a central column 9 defined by an upper portion 10 and a lower portion 11 which both extend in sequence along the A axis, of which the portion 10 presents a number of housings or passing holes 12 arranged transversally to the A axis and each a given step K one from the other along the A axis itself.

The control group 8 comprises a guiding device 13 suitable for moving the tool 6 parallel to the A axis, and an orientation device 14, which is connected to the device 13 itself, and is suitable for rotating the tool 6 around the axis B between an operating position for transport, in which the tool 6 is substantially lying above the truck 2 with the relative A axis arranged horizontally, and a final working operating position, in which the tool 6 is driven into the ground with the relative A axis arranged vertically.

The guiding device 13 is a step by step device suitable for moving the column 9 in relation to the truck 2 by guiding the column 9 itself parallel to the A axis, and comprising two grippers 15 and 16 which are selectively slidingly coupled to the column 9 along the portion 10 of the column 9 itself, and a linear step actuator 17 which is interposed between the grippers 15 and 16 themselves for moving the gripper 16 both in relation to the gripper 15 and in relation to the truck 2.

Figure 6:
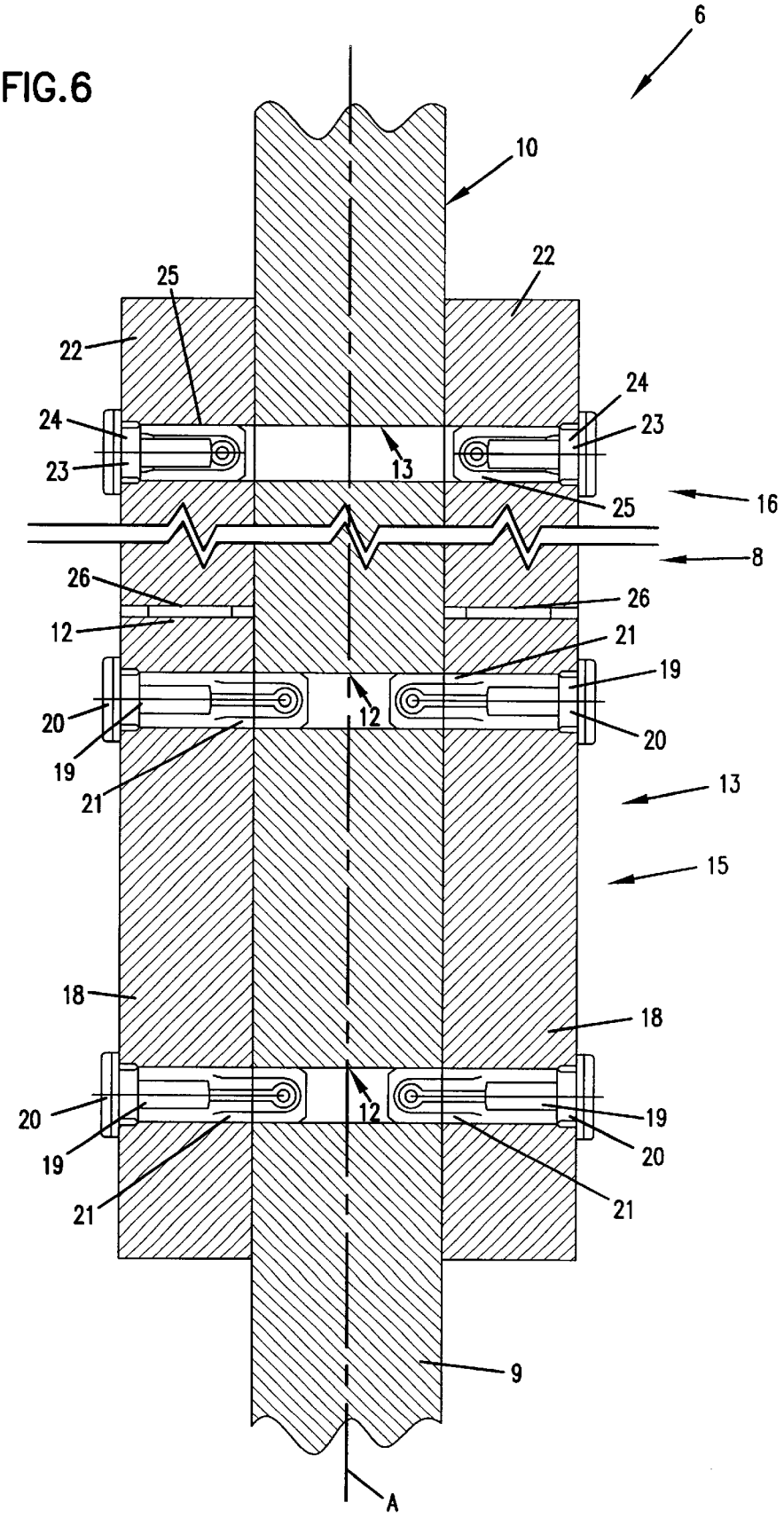
FIG. 6 shows, on an enlarged scale and with some parts in section and others removed for purposes of clarity, a detail of the trench rig shown in FIG. 1.
Figure 9:
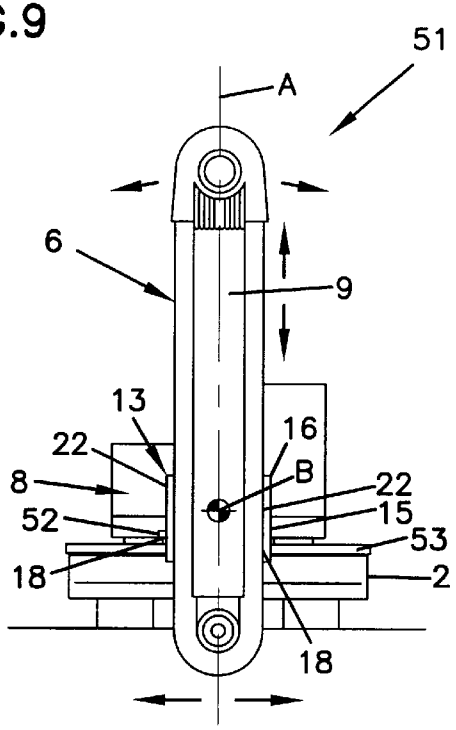
FIGS. 8 and 9 are, respectively, a lateral elevation view and a frontal elevation view of the trench rig shown in FIG. 7

The gripper 15 is rigidly angularly connected to the orientation device 13 and is slidingly connected to the column 9, and, as is better illustrated in FIG. 6, comprises two plates 18 arranged laterally opposite the column 9, and for each plate 18, a pair of jacks 19 is arranged along the A axis each at a distance equal to a step K one from the other. The pair of jacks can be activated at the same time and at the same time as the other pair of jacks 19 in order to block the slide of the column 9 itself along the relative A axis in relation to the relative plate 18. Each jack 19 comprises a fixed portion 20 which is rigidly connected to the relative plate 18, and a mobile portion 21 which is selectively engageable inside the holes 12, and is transversally mobile to the A axis between a retracted disengaging position and an extracted engaging position, in which it is partially arranged inside a hole 12.

The gripper 16 is axially slidingly connected to the column 9, and it comprises two plates 22 arranged laterally opposite the column 9, and for each plate 22, a jack 23, which is arranged along the A axis at a distance equal to the step K from the jacks 19 above the plates 18, and which can be activated independently of the jacks 19 themselves, and at the same time as the other jack 23 to block the slide of the column 9 itself along the relative A axis and in relation to the relative plate 22. The jacks 23 are similar to the jacks 19, and each comprise a fixed portion 24 which is rigidly connected to the relative plate 22, and a mobile portion 25 which is selectively engageable inside the holes 12, and is transversally mobile to the A axis between a retracted disengaging position, and an extracted engaging position, in which it is partially arranged inside a hole 12.

The linear step actuator 17 is suitable for moving the gripper 15 at each step in relation to the gripper 16 in accordance with a given length equal to the step K, and comprises, for each pair of plates 18 and 22, two pistons 26, which are interposed between a plate 18 of the gripper 15 and the plate 22 of the gripper 16 arranged on the same part of the column 9, and these are suitable for distancing and/or bringing together the relative plates 18 and 22, or the grippers 15 and 16.

The orientation device 14 comprises two clamps 27, which are constrained to the truck 2 in order to rotate around the B axis, and these are constrained to the plates 18, and two further pistons interposed between the clamps 27 and the truck 2 [itself] in order to rotate the clamps 27 themselves, or to orientate the tool 6.

The operation of the trench rig 1 will now be described with particular reference to the movement of the column 9, omitting a description of the well-known specific operating details of a "trencher".

Figure 5A:
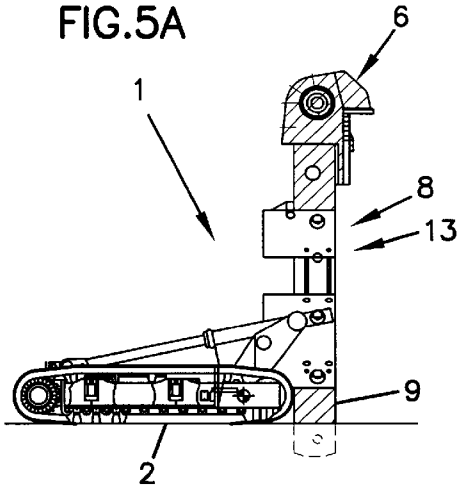
FIGS. 3, 4 and 5 show a lateral elevation view, with some parts removed for purposes of clarity, illustrating a sequence of operating positions of the trench rig shown in FIG. 1.
Figure 5B:
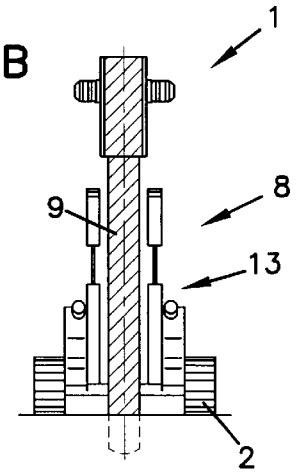
Figure 4A:
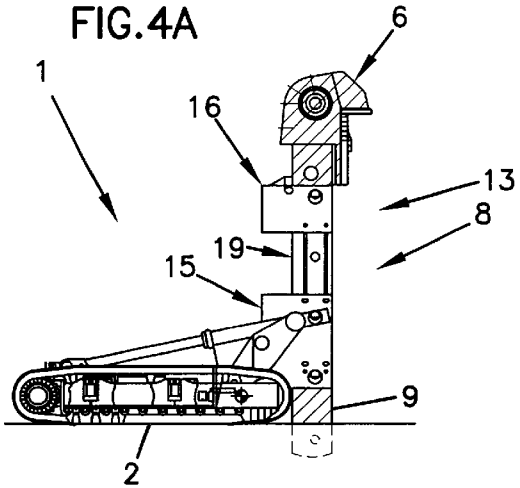
Figure 4B:
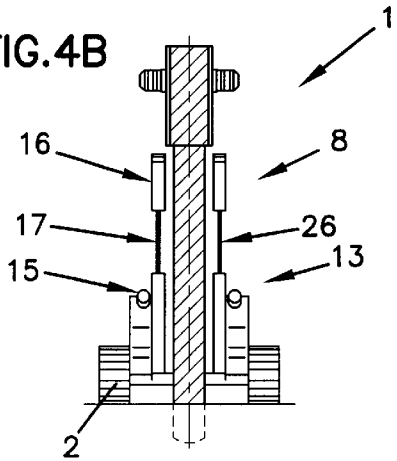
Figure 3A:
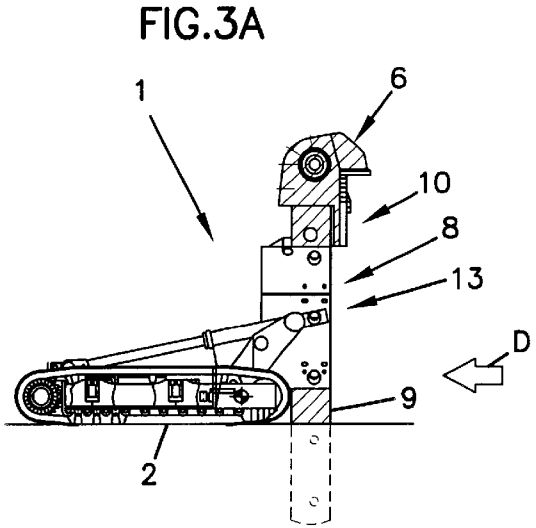
Figure 3B:
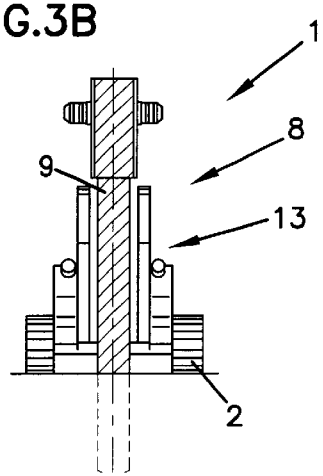

According to the illustration shown in FIGS. 3, 4 and 5, once the tool 6 has been activated in such a way as to begin the removal of earth, and the orientation device 14 has caused the excavating tool 6 to achieve a given driving angle by rotating the column 9 with the clamps 27 around the B axis, the device 13 moves the column 9 in such a way as to vary the depth of the trench 7.

In order to move the column 9 along the A axis by the depth of a given step K it is necessary to start from an initial operating situation, in which the column 9 is blocked both by the gripper 15 and the gripper 16 with the jacks 19 and 23 arranged in their extracted engaging position, and with the two grippers 15 and 16 arranged in such a way that they are substantially in contact with each other. At this point, the jacks 23 are arranged in their extracted disengaging position in such a way as to release the column 9 from the constraint of the gripper 16, but not from the constraint of the gripper 16, and subsequently the pistons 26 are activated to cause movement of the gripper 16 in relation to the gripper 15: this is so that the gripper 16 is released from the constraint of the column 9 in order to obtain a sliding action of the gripper 16 in relation to the column 9 along the A axis by a step K.

A this point, the jacks 23 are arranged in their operating position when in use, and once the column 9 is blocked by the gripper 15, the jacks 19 are arranged in their operating position when not in use to release the column 9 from the constraint of the gripper 15, but not from the constraint of the gripper 16. Subsequently, the pistons 26 move the gripper 16 closer to the gripper 15 so that the column 9 moves in a downwards direction by a step K and the column 9 slides in relation to the gripper 15 itself, which functions as an axial guide for the column 9.

When the two grippers 15 and 16 are once again in the described initial operating position, it is possible to carry out a new movement of the column 9, either in an upwards or a downwards direction.

In order to move the column 9 in an upwards direction along the A axis a step K from the described initial operating position, the jacks 19 are arranged in their extracted disengaging position is such a way as to release the column 9 from the constraint of the gripper 15, but not from the constraint of the gripper 16 and, subsequently, the pistons 26 are activated to cause movement of the gripper 16 in relation to the gripper 15: as the gripper 16 is integral with the column 9 there is also a movement of the column 9 by a step K along the A axis, and an axial slide of the column 9 in relation to the gripper 15, which, as previously described, functions as an axial guide for the column 9 itself.

Once the column 9 has been raised by a step K, the jacks 19 are arranged in their extracted engaging position, and when the column 9 is once again blocked by the gripper 15, the jacks 23 are arranged in their retracted disengaging position: in this way the column 9 is axially blocked by the gripper 15, but is not axially blocked by the gripper 16.

It is obvious from the above description that the previously described trench rig is particularly suitable for the excavation of trenches 7 of considerable depth without being limited by the presence of overhead obstacles in the excavation area in that the group 8 moves and at the same time guides the column 9 without letting anything protrude above the column 9 itself as in the case of well-known trench rig provided with a guide antenna. Furthermore, given that the position of the column 9 is always kept under control by the two grippers 15 and 16, it is also possible to vary the driving angle of the tool 6 during excavation, thereby rendering the trench rig 1 more versatile.

Figure 8:
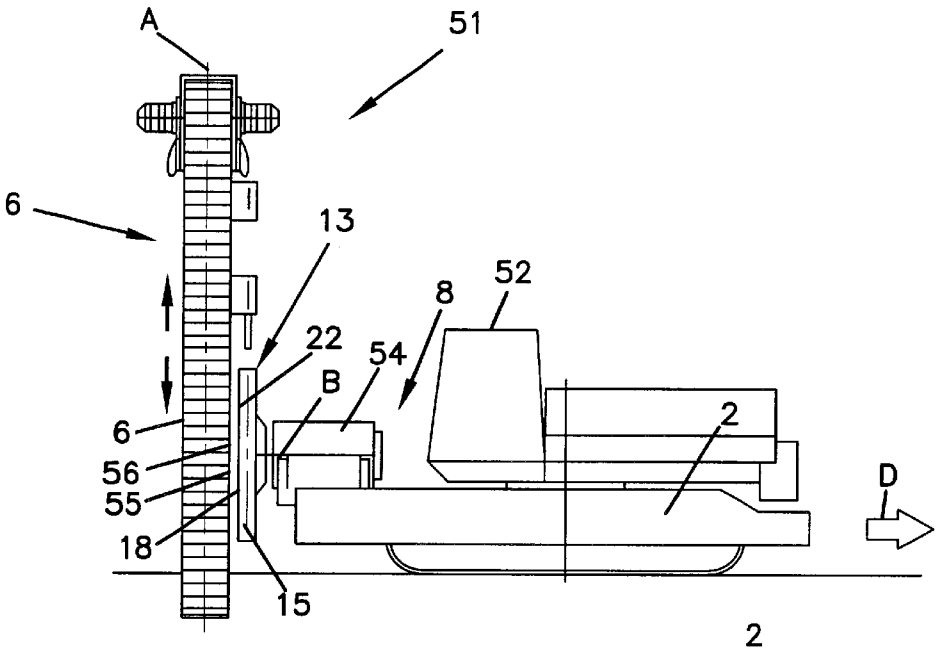
Figure 7:
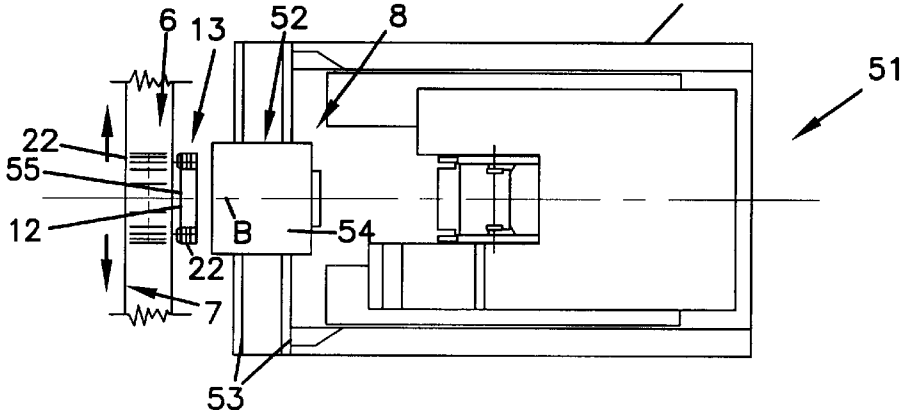
FIG. 7 shows a plan view of a second preferred embodiment of a trench rig according to the present invention.

The embodiment illustrated in FIGS. 7, 8 and 12 relates to a trench rig 51 which is substantially similar to the trench rig 1, from which the trench rig 51 differs in the first instance due to the fact that the orientation axis B is arranged parallel to the direction D in such a way as to be able to excavate a series of trenches 7 arranged transversally to the direction D each at a given distance one from the other, and, in the second instance the trench rig 51 differs from the trench rig 1 due to the fact that the tool 6 is defined by a lateral milling module cutting miller.

Furthermore, the trench rig 51 differs from the trench rig 1 in that the orientation device 14 is replaced by an orientation device 52 comprising, instead of the clamps 27 and the pistons 26, two guides 53 which are integral with the truck 2 and which are arranged transversally to the B axis, a slide 54 slidingly mounted along the guide 53, and a support shaft 55, which is revolvingly mounted along the B axis by means of the slide S4, and which supports the gripper 15 at one of its ends.

The orientation device 52 is suitable for rotating the tool 6 around the B axis in both a clockwise and anti-clockwise direction and, furthermore, is suitable for translating the slide 54 along the guide 53.

Finally, the plates 18 and 22 of the grippers 15 and 16 no longer extend completely opposite the column 9, instead they are only partially arranged along the sides of the column 9 as they are coupled to a prismatic guide 56, which is integral with the column 9 itself, and which extends along the whole length of the column 9, and which is provided with holes 12.

The way the trench rig 51 functions is easily inferable from the preceding description and does not, therefore, require any further description. Is, however, necessary to point out that the tool 6 of the trench rig 51 no longer excavates a continuous trench 7, but instead excavates a number of trenches 7 arranged one beside the other transversally to the direction D. Furthermore, the excavation of each trench 7 is realised by stopping the truck 2, moving the tool 6 along the guide 53 parallel to itself and orientating the column 9 around the B axis.

What is claimed is:

1. A trench rig (1) (51) comprising an excavating tool (6) presenting a working axis (A), and means of transport (2) associated with the excavating tool (6) for transporting the excavating tool (6) in a given direction (D); the rig (1) (51 ) further comprising control means (8) which are directly interposed between the excavating tool (6) and the means of transport (2) for controlling the excavating tool (6) around an axis of orientation (B) which is transversely orientated to the working axis (A) and along the working axis (A); the control means (8) comprising clamping means (15, 16) which are selectively engageable directly onto said excavating tool (6) in order to move the excavating tool (6) along the working axis (A), wherein the clamping means (15, 16) comprise a fixed portion (15) and a mobile portion (16) parallel to said working axis (A); the fixed portion (15) is selectively slidingly coupled to the excavating tool (6) and is interposed between the means of transport (2) and the excavation tool (6), and the mobile portion (16) is mobile in relation to the fixed portion (15) and the excavation tool (6).

2. A trench rig according to claim 1, wherein the clamping means (15, 16) further comprise a linear step actuating means (17) which is interposed between the fixed portion (15) and the mobile portion (16) to move the mobile portion (16) by a given step (K) in relation to the fixed portion (15).

3. A trench rig according to claim 1, wherein the fixed portion (15) and the mobile portion (16) each comprise two respective guide plates (18, 22) which are axially slidingly coupled to the excavating tool (6); and engaging means (19, 23) which selectively engage the excavating tool (6); the engaging means (19, 23) being supported by at least one plate of the plates (18, 22) for each of the fixed and mobile portions (15, 16).

4. A trench rig according to claim 3, wherein the excavating tool (6) comprises a central column (9) provided with a number of housings (12) distributed along the working axis (A) and which are at an equal distance one from the other which is equal to a step (K).

5. A trench rig according to claim 4, wherein the housings (12) are arranged transversely to said central column (9); the plate supporting the engaging means (19, 23) being arranged, in relation to the central column (9), adjacent to the housing (12).

6. A trench rig according to claim 4, wherein the housings (12) are arranged on both sides of said central column (9) and both the two plates (18, 22) support the engaging means (19, 23).

7. A trench rig according to claim 3, wherein the engaging means (19, 23) comprise at least one jack (19, 23) for each of the plates (18, 22).

8. A trench rig according to claim 7, wherein the engaging means (19, 23) comprise two jacks (19) supported by each plate (18) of the fixed portion (15), and a jack (23) supported by each plate (22) of the mobile portion (16).

9. A trench rig according to claim 1, wherein the control means (8) comprise an orientation device (14) (52) for orientating the excavating tool (6) around the orientation axis (B); the orientation device (14) (52) being interposed between the fixed portion (15) and the means of transport (2).

10. A trench rig according to claim 9, wherein the orientation device (14) pivots in relation to said means of transport (2), and comprises two clamps (27) which are rigidly angularly connected to the fixed portion (15).

11. A trench rig according to claim 10, wherein the orientation axis (B) is transverse to the given direction (D).

* * * * *